United States Patent [19]

Lichter

[11] 4,176,440

[45] Dec. 4, 1979

[54] SAFE, AND METHOD AND APPARATUS FOR BUILDING IT

[76] Inventor: Robert J. Lichter, 15571 Placid Cir., Huntington Beach, Calif. 92647

[21] Appl. No.: 890,489

[22] Filed: Mar. 27, 1978

Related U.S. Application Data

[63] Continuation-in-part of Ser. No. 758,587, Jan. 12, 1977, abandoned.

[51] Int. Cl.[2] ..... E05G 1/00

[52] U.S. Cl. ..... 29/458; 109/80; 109/68

[58] Field of Search ..... 29/458, 460, 527.3, 29/527.1; 109/80, 82–84, 64, 77, 68, 83; 206/223

[56] References Cited

U.S. PATENT DOCUMENTS

| | | | |
|---|---|---|---|
| 891,969 | 6/1908 | Anderson | 109/50 |
| 960,982 | 6/1910 | Meilink et al. | 109/50 |
| 1,084,837 | 1/1914 | Arnold | 109/68 |
| 1,421,150 | 6/1922 | Bennet | 109/83 |
| 1,854,839 | 4/1932 | Hermann | 109/59 R |
| 1,887,866 | 11/1932 | Belknap | 109/59 R |
| 1,967,779 | 7/1934 | Paca | 109/59 R |
| 2,209,007 | 7/1940 | Belknap | 109/59 R |
| 2,819,692 | 1/1958 | Johnson et al. | 109/50 |
| 3,481,288 | 12/1969 | Teleky | 109/58 |
| 3,653,343 | 4/1972 | McMartin | 109/64 |
| 3,715,998 | 2/1973 | Teleky | 109/58 |
| 3,747,541 | 7/1973 | Reese | 109/50 |
| 3,842,761 | 10/1974 | Bloom | 109/64 |
| 4,048,926 | 9/1977 | Brush et al. | 109/83 |

*Primary Examiner*—Milton S. Mehr
*Attorney, Agent, or Firm*—Richard L. Gausewitz

[57] ABSTRACT

A "do it yourself" burglar-resident safe is provided at extremely low cost. The present apparatus and method make it possible and practical for almost any person, even a person having a low degree of manual skill and even a low intelligence, to construct his or her own safe with precision.

In a preferred embodiment, a plastic liner is precision saw-cut or molded at the factory to provide various slots or grooves adapted to receive the inner edge portions of steel bars having predetermined sizes. The customer purchases the liner and bars in unassembled condition, together with a bottom, a firecap mold, and a strong steel door with associated lock. At any desired region of his home, the customer provides form means sufficiently large to receive the liner and having as much capacity as the customer wishes. Then, the customer inserts the bars into the factory-made slots so as to precisely locate the bars, closes the bottom at the end of the liner, introduces the liner into the form, pours concrete around the liner, and the safe is completed. Major portions of the bars are embedded in the concrete and thus cannot be removed. There is also provided a simple and economical, but highly effective, relocking means.

16 Claims, 11 Drawing Figures

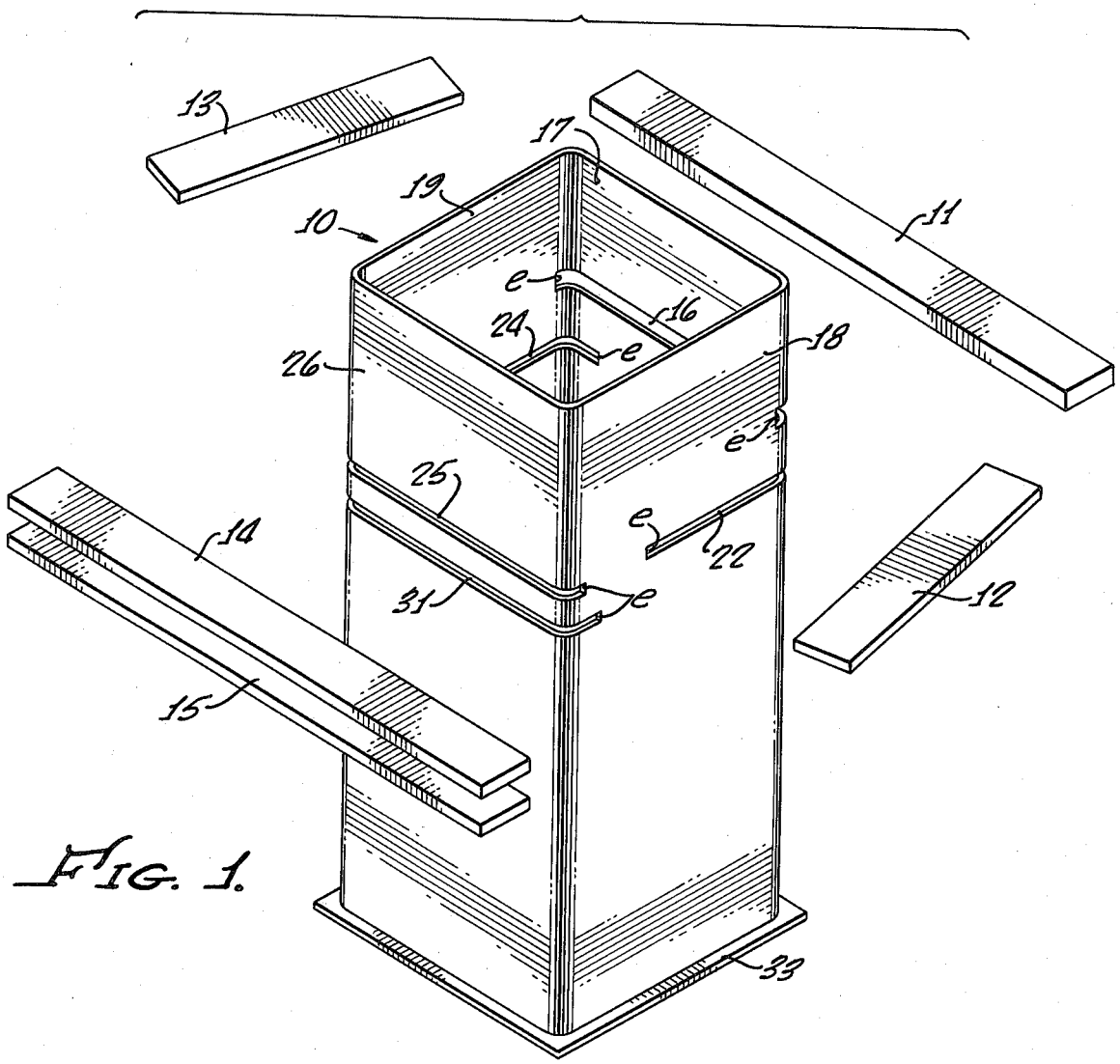
FIG. 1.
FIG. 5.
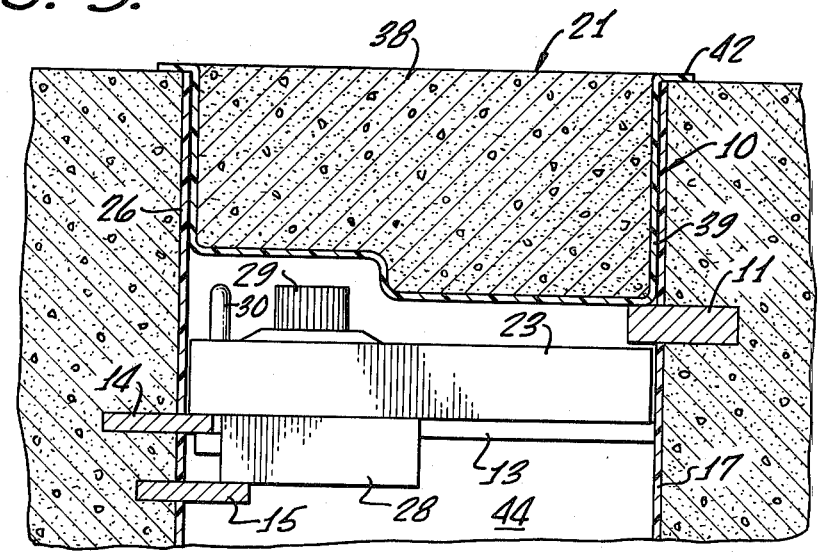

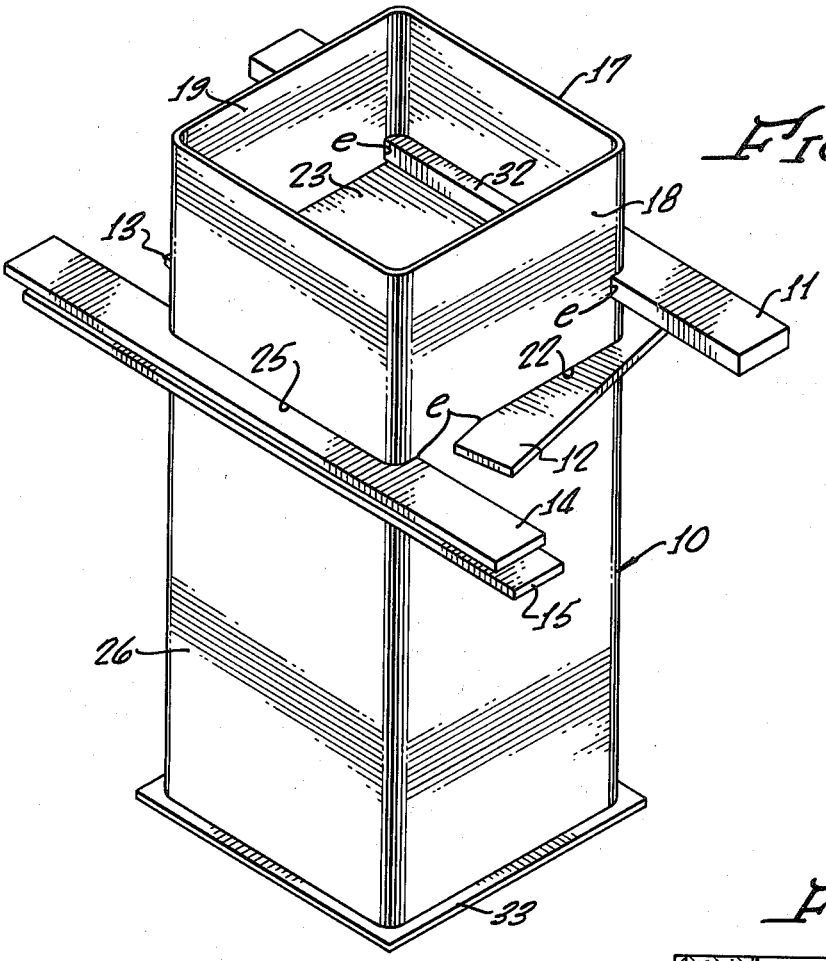
FIG. 1a.
FIG. 6.
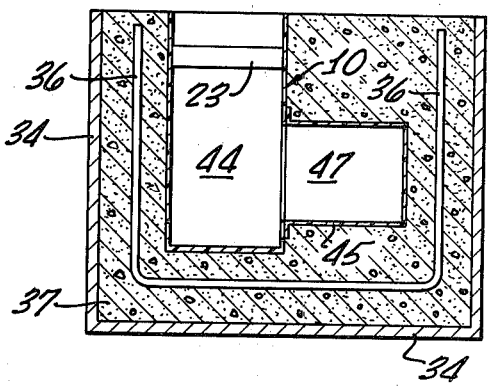
FIG. 4.
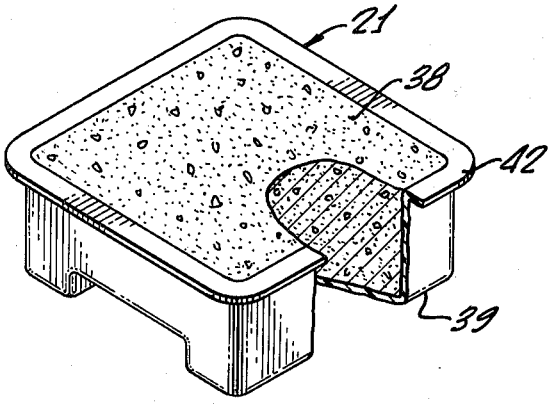
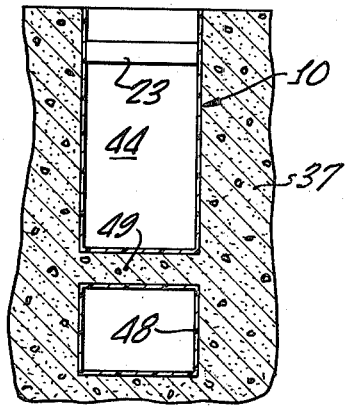
FIG. 7.

FIG. 8.
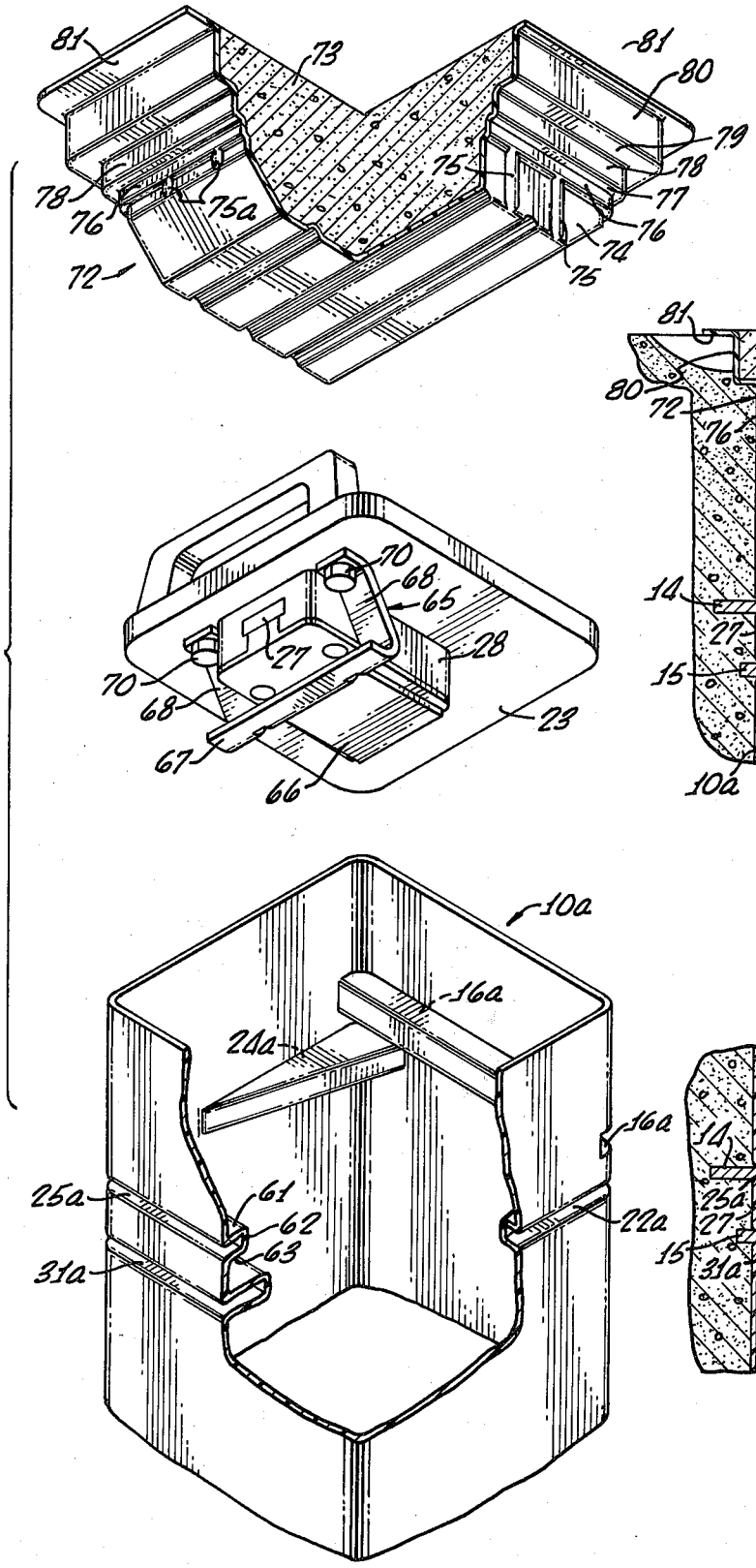
FIG. 9.
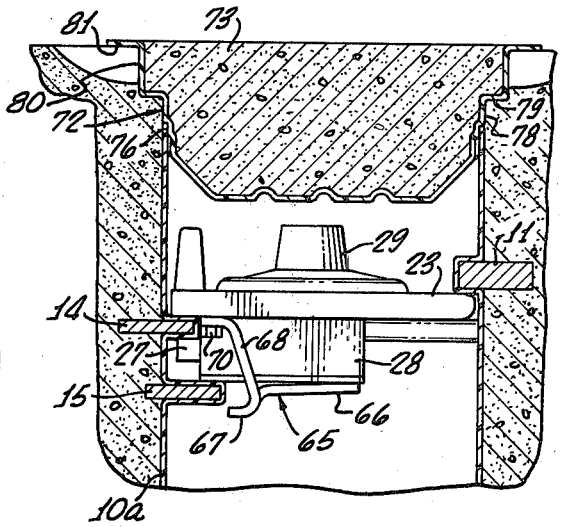
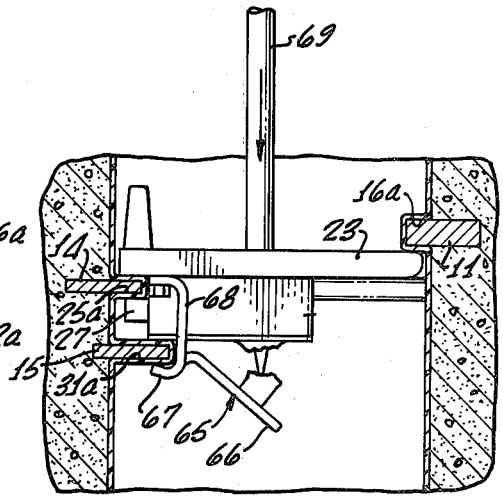
FIG. 10.

SAFE, AND METHOD AND APPARATUS FOR BUILDING IT

CROSS-REFERENCE TO RELATED APPLICATION

This is a continuation-in-part of my copending application Ser. No. 758,587, filed Jan. 12, 1977, abandoned.

BACKGROUND OF THE INVENTION

1. Field of the Invention

This invention relates to the field of safes adapted to contain valuable articles and papers.

2. Description of the Prior Art

There are numerous prior art wall and floor safes adapted to be embedded in concrete, etc. In all of such safes of which applicant is presently aware, there was a very large amount of manufacturing at the factory, so that the installer merely embedded the entire pre-manufactured unit in concrete. Because all or substantially all of the real manufacturing occurred at the factory, such prior art safes were expensive to manufacture, expensive and bulky to ship and store, etc. Futhermore, in many instances the prior art safes were no better than, or not as good as, the present safe in regard to resistance to burglary, fire, and moisture.

Prior art safes have often included fire doors and/or relocking devices, but usually of relatively expensive construction requiring much manufacturing operations at the factory. For example, it is common to provide relocking devices in the form of spring-pressed sliding bolts.

SUMMARY OF THE INVENTION

According to the present invention and method, the amount of manufacturing which occurs at the factory is extremely small. In one basic form of the apparatus, the manufacturer need only take a standard plastic extrusion (already on the market), make some saw-cuts therein at locations precisely determined by a jig, buy some steel bars, combine a standard lock with a steel plate which serves as a door, make one or two plastic end elements by inexpensive vacuum forming or the like, provide very economical fire-door and relocking means, and the product is complete insofar as the manufacturer is concerned. The elements are shipped and stored "knocked down," for example, with the steel bars contained within the extrusion, for minimized shipping space and consequent low cost of shipping and storage.

Not only do the present apparatus and method provide a manufacturing breakthrough, as indicated above, but there results a highly effective safe for the purchaser. The purchaser pays a relatively low price for the components, and furthermore has numerous options which permit him to construct a safe of various sizes (as desired) and having surprisingly high resistance to burglary. It is very difficult for the purchaser to construct the safe incorrectly, regardless of his or her degree of skill. Furthermore, it is economical for the purchaser to change the combination when desired since—in the preferred embodiments—the door is completely removable from the remaining portions of the safe and thus may be taken to a locksmith.

The invention provides a liner which performs the functions of a jig, fixture, and concrete form, which may be very light-weight and low-cost, and which precisely locates strong elements creating great burglar resistance. The strong elements (preferably steel bars) are disposed partly within the concrete and partly within openings or recesses in the jig or form (liner). Bar-locating openings in the form of slots or grooves are provided and make it highly difficult for even an inexperienced person to make a mistake in placing the bars in the liner. When the concrete is poured, larger outer portions of the bars are fixedly embedded and secure. Very importantly, in the embodiment where there are slots clear through the liner, the bars seal in their slots for prevention of inward flow of concrete and grout. The steel door is already pre-manufactured and is readily introduced into the liner. The bar arrangement is such as to afford great security against both outward and inward movement of the door and its lock.

In accordance with another aspect of the invention, a special cup-shaped element is provided and adapted to seat in the liner above the steel door. The person building the safe in his own home fills the cup with concrete at the time when the liner and steel are being embedded. Then, after the concrete hardens, the cup is set in place over the locked door and affords an increased amount of fire protection.

In accordance with the relocking aspect of the invention, there are no springs, or sliding elements. Instead, there is a special bendable element which can be formed very economically from a single piece of steel.

BRIEF DESCRIPTION OF THE DRAWINGS

FIG. 1 is an isometric exploded view showing the safe prior to assembly and prior to pouring of the concrete;

FIG. 1*a* is an isometric view showing the combination jig and form (liner) after the steel bars have been mounted in the pre-cut slots, and prior to the time that concrete has been poured to embed the protuberant regions of the bars;

FIG. 4 is an isometric view showing the firecap as separated from the safe;

FIG. 5 is a vertical sectional view corresponding to the upper portion of FIG. 3 but showing also the firecap in seated position over the door;

FIG. 6 is a vertical sectional view of an embodiment wherein the size of the safe is extended by means of a lateral compartment;

FIG. 7 is another vertical sectional view illustrating the presence of a secret compartment below the main safe compartment;

FIG. 8 is an exploded perspective view of another embodiment of the safe, showings of the bar being omitted;

FIG. 9 is a vertical sectional view showing the embodiment of FIG. 8 after the safe has been constructed and closed; and FIG. 10 shows what happens to the structure of FIGS. 8 and 9 when a burglar tries to drive down the lock.

DETAILED DESCRIPTION OF THE PREFERRED EMBODIMENT

Figure 2:
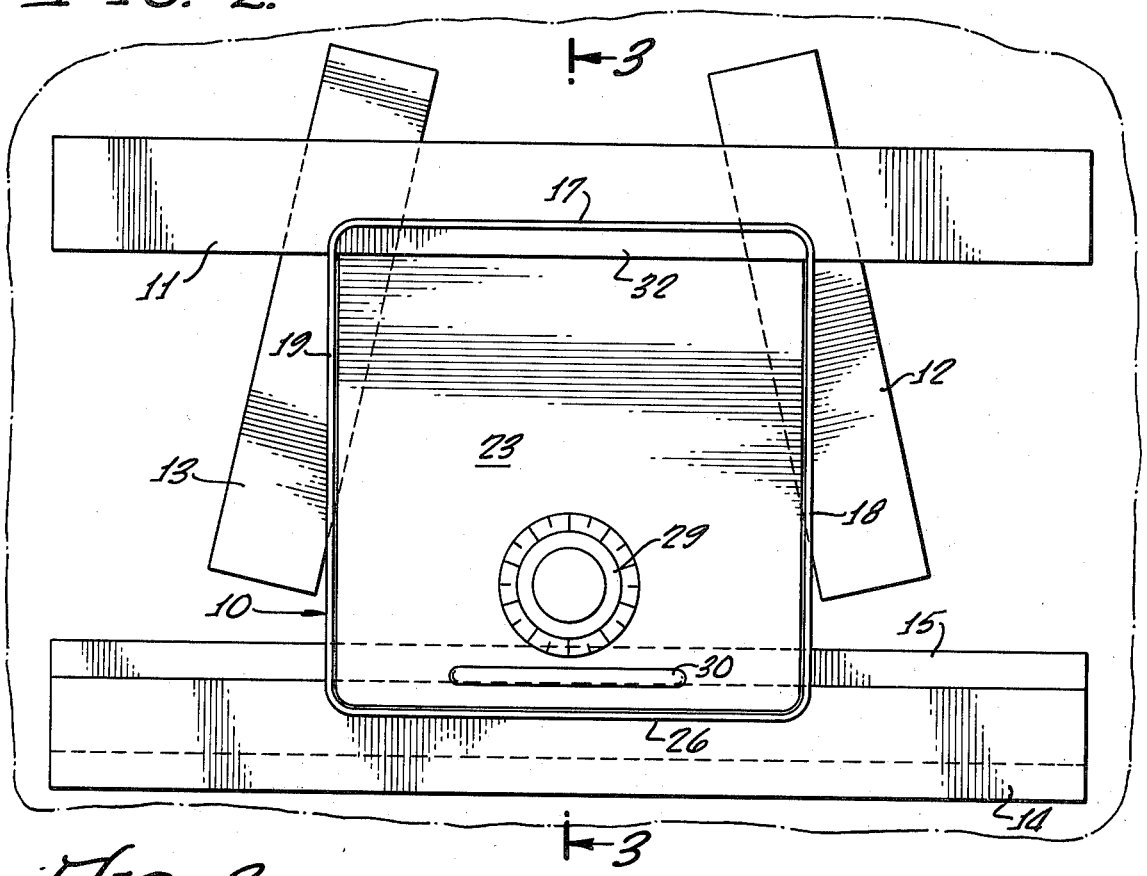
FIG. 2 is a top plan view of the showing of FIG. 1*a;*

The word concrete, as used in this specification and claims, is to be understood as comprehending other strong and burglar-resistant moldable materials which may be readily molded around the present liner by a homeowner.

For low-volume production, the present liner is preferably a plastic extrusion, but for high-volume production it is preferably an injection molded plastic element. It is to be understood that either type of liner element is comprehended within the present specification and claims.

Referring now to FIG. 1, the liner is numbered 10 and is illustrated as being an elongated hollow extrusion formed, for example, of a thermoplastic resin such as impact styrene. Liner 10 may, however, be formed of a thermosetting resin or other fire-resistant and heat-insulating substance. One such thermosetting resin is a phelol-formaldehyde resin sold under the trademark "Bakelite." The illustrated liner 10 has a square cross section, it being understood that various other cross-sectional shapes are possible.

Liner 10 defines the opening through which valuables are introduced into a valuables chamber 44. It also defines the valuables chamber 44 itself. The liner serves not only as an interior form for the concrete, but also as a jig or fixture for holding in precisely determined positions various steel bars 11–15, inclusive. Each of such bars 11–15 is preferably rectangular in cross-sectional shape and is disposed in a plane perpendicular to the axis of liner 10. The elments 11–15 are referred to throughout as "bars" although they may also, in some instances, actually be plates, etc.

The liner need only be sufficiently thick and strong to (1) prevent its being caved-in by the wet concrete and (2) provide effective support for the bars prior to and during concrete pouring.

The various bars 11–15 are disposed in slots or openings in liner 10, the relationships being such that part of each bar is inside the liner and part of each bar is on the outside thereof. The slots are so dimensioned as to receive the respective bars in a relatively light-press fit relationship, such that after the customer manually presses a bar into its associated slot there will be no danger of slippage. Futhermore, the bars are sufficiently snug fit in the slots so as to prevent substantial ingress of grout during pouring of the concrete. The fit is such that the pressure exerted by the wet concrete will not shift the bars.

The various slots in the liner are either precision saw-cut therein, using jigs, or are formed therein during injection molding.

Bar 11 is preferably a relatively thick steel bar of rectangular cross section, being disposed in an associated slot 16 (FIGS. 1 and 3) in one sidewall 17 of the liner. Slot 16 not only extends the full width of sidewall 17 but also extends partially into the adjacent sidewalls 18 and 19. The amount by which slot 16 extends into sidewalls 18 and 19 determines the degree of penetration of the bar 11 into the slot, since the customer pushes the bar in as far as it will go. This degree of penetration is caused to be sufficiently great to effectively prevent upward movement of the associated edge of the steel door described below, but sufficiently small to permit pivoting of such door between the positions shown in solid and phantom lines in FIG. 3. The various slot ends, which determine the degree of bar penetration, are all numbered "e" in FIG. 1, etc.

Bar 11 is caused to be much longer than the associated dimension of sidewall 17, so that there are protuberant ends which extend substantial distances into the surrounding concrete. The relationships are very preferably caused to be such that the major portion of bar 11 is embedded in the concrete, being exterior to liner 10, whereas the minor portion of the bar is disposed within the hollow interior of the liner. The exact position of the bar is unimportant so long as its inner edge engages the associated slot ends e. Stated otherwise, the interior bar portion is precisely located but the exterior bar portion need not be.

The bar 11 is spaced downwardly a substantial distance below the upper rim of the liner, in order to make room for the firecap 21, shown in FIGS. 4 and 5 and described in detail below. Also, and very importantly, the mounting of bar 11 far below the upper end of the liner (and thus far below the upper surface of the surrounding concrete) produces the highly beneficial result of making it much more difficult for a burglar to work on any portion of the bar or otherwise break into chamber 44.

The next two steel bars, numbers 12 and 13, are disposed in spaced relationship below bar 11 and may be termed corner bars in that they are angularly disposed in the two corners of the liner below slot 16. Thus, bar 12 is lightly press-fit into a slot 22 in the vertical corner where sidewall 18 meets sidewall 17. Correspondingly, bar 13 is lightly press-fit into a corresponding slot 24 in the corner where the two walls 17 and 19 meet.

Bars 12, 13 lie in a plane spaced below that of bar 11. All bars preferably lie in planes perpendicular to the axis of the liner.

Each of the bars 12 and 13 is preferably, as is the case relative to bar 11, so sized that only a minor portion of the bar is within the liner and a major portion of the bar is exterior thereto for strong embedment in the surrounding concrete. The exact positions of the interior portions of bars 12 and 13 are determined by the ends e of the associated slots 22, and 24. These positions are such that there will be strong undersupport for the steel door of the safe without, however, substantially restricting access to the safe when the door is removed. Furthermore, these positions are such as to support the end of the heavy steel door during its insertion.

The door is preferably a square steel plate, numbered 23, which is thick and thus burglar-resistant, and which preferably has a thickness only slightly less than the vertical spacing between the underside of bar 11 and the upper sides of bars 12 and 13. (Door 23 may also be made somewhat thicker than such vertical spacing, by providing an indented region or corner groove at the upper-right portion of the door as viewed in FIG. 3. Thus, for example, an owner who decides he wants more burglar protection may trade in a less-thick door for a thicker one.)

As above indicated, the locations of the interior portions of bars 12 and 13 (those within the liner 10) are caused to be such as to afford support for the edge of door 23 when the door is lowered during the door insertion and closing operation described below. To insert the door, the user grasps a handle 30 which is relatively adjacent the edge remote from bar 11 when the door is in position. He or she then lowers the handle and thus the door (which is then generally vertical) until the lower edge of the door engages the upper surfaces of the interior portions of bars 12 and 13, then further lowers the handle to cause counterclockwise pivoting of the door to the position shown in phantom lines in FIG. 3, and then further lowers the handle until the door is in the horizontal position shown in solid lines therein. The right region of the door (FIG. 3) is then firmly positioned between the bars 11 and 12–13, so that such right region may be neither pulled up nor driven down by a burglar.

The door edge remote from bar 11 rests on a bar 14 which is lightly press-fit into a slot 25 (FIGS. 1 and 3) in the remaining sidewall 26 of the liner. Bar 14 is preferably in the same plane as bars 12–13, as illustrated, and has been manually pushed into slot 25 the entire distance permitted by the ends e of such slot 25. These ends of slot 25 are in sidewalls 18 and 19.

As in the case of bar 11, bar 14 is preferably much longer than is the corresponding dimension of the liner, so that there will be bar ends of substantial length embedded in the concrete. Furthermore, and as is the case relative to the other bars, only a minor portion of bar 14 is preferably inserted into the slot 25 so as to be within the interior of the liner 10.

All of the bars are not only much longer than the slots, but aslo much wider than the slot depths except at the two corners receiving bars 12 and 13, as shown in FIG. 2.

Bar 14 thus cooperates with bars 12 and 13 in preventing a burglar from driving the door 23 downwardly in an attempt to achieve access to the contents of the safe. Furthermore, bar 14 (that is to say, the interior portion of bar 14) is the stop below which the bolt 27 of the lock 28 is inserted (toward the left in FIG. 3) in order to prevent the door from being opened. The lock 28 is a suitable strong combination or key type, in the present instance being illustrated as a combination lock operated by a knob 29 on the upper surface of the door.

When a burglar removes the knob of a well-constructed combination safe lock, and then dislodges the mechanism thereof, the bolt 27 will be automatically locked in postion henceforth serving as a deadbolt. This is done by a mechanism well known in the safe lock art, which mechanism is present in lock 28. Therefore, a favorite ploy of burglars is to attempt to drive the lock 28 downwardly. To further prevent such action, and to afford additional resistance to attempts to drive the left side (FIG. 3) of the doorwardly, the fifth bar 15 is provided in a slot 31 in sidewall 26. Reference is made to the subheading "Relocking Means" for a description of an economical element which cooperates with bar 15 to increase greatly the security of the safe.

Such fifth bar 15 is introduced further into its slot 31 than is bar 14 into its slot 25, in order that the inner edge of the bar 15 (right edge in FIG. 3) will be disposed beneath a substantial portion of the lock 28 as illustrated. Stated otherwise, slot 31 is much deeper than slot 35, its ends e being much farther to the right (FIG. 3) than are the ends of slot 25. The bar 15 is much longer than is the width of the wall 26, for purposes described above relative to the other bars.

Figure 3:
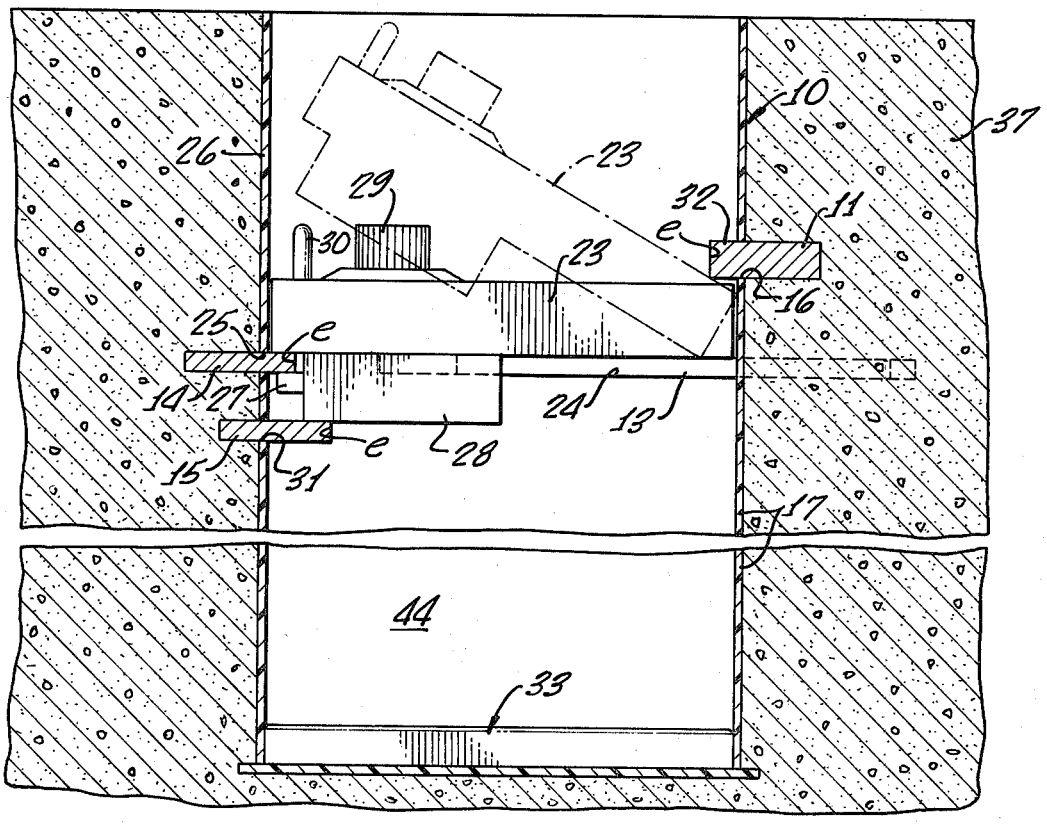
FIG. 3 is a vertical sectional view on line 3—3 of FIG. 2, showing the surrounding concrete, and also showing in phantom lines a pivoted position of the door.

Let it be assumed that the entire structure exterior to liner 10 has been embedded in concrete as described below. Let it also be assumed that the door 23 has been lowered into position, as described, and that knob 29 has been turned to cause bolt 27 to protrude to the left beneath bar 14 for locking of the safe as shown in FIG. 3. When a burglar then views the closed safe, all he sees are (1) the thick steel door 23 which is disposed a substantial distance beneath the upper surface of the concrete and (2) the interior portion of thick bar 11. Such door is a relatively tight fit within the liner 10, although preferably not a press-fit therein, so that the burglar cannot work around it. The interior bar edge portion, like the entire bar 11, may be of any desired thickness, for example between ½ and 1½ inches, and thus prevents a very formidable obstacle to the burglar.

If the burglar decides to try to remove door 23 by working on the knob 29 and the lock 28, the above-described results occur whereby bolt 27 becomes a deadbolt and the lock 28 is prevented by bar 15 from being driven down. As described, the entire door is prevented from being driven down by bars 12–15, inclusive. The burglar then has the option of attacking the enclosing concrete, for example with a sledge hammer. His successes in any such efforts will be determined solely by the amount of concrete reinforcing bars and wire mesh which the homeowner desires to build around the liner.

Method of Manufacturing the Safe In The Home, Office, Garage, Etc.

The various bars 11–15 may be slipped within the liner 10, just as the door 23 may be shipped within the liner so that only a minimal amount of shipment and storage space is required. The homeowner then manually presses the bars in the slots therefor, to the full extent permitted by the depths of the slots (that is to say by the precise locations of the ends e of the slots). Being pressed into their slots, they stay firmly and sealingly in place.

The homeowner also glues a bottom element 33 at the lower end of the liner. Such bottom element is preferably formed by vacuum forming or injection molding, having a flange portion of larger diameter than that of the liner and having an interior portion which extends upwardly into the liner bottom.

The homeowner then selects any desired forms whatever. He may, for example, employ a plastic or metal trash can as a form, or a large waste basket, or a clothes holder. He may also employ sheets of plywood, etc., or a large hole in the floor of his basement. The size of the cavity within the forms (that is to say the exterior forms, since liner 10 itself serves as the interior form) determines the weight of the concrete and thus the resistance of the safe to being carried off by a burglar. The safe may be caused to weigh several hundred pounds if desired.

Referring to FIG. 6, forms are represented schematically at 34 and define a cavity which is exterior to liner (inner form) 10 and interior to the forms 34. Concrete is then introduced into this cavity, either all at once if the homeowner is a home handyman type, or else in slow stages using sacked concrete. If desired, reinforcing bars (such as are indicated at 36 in FIG. 6) may be introduced vertically and horizontally at various portions of the concrete. Wire mesh is also, very desirably, embedded in the concrete.

While he is pouring concrete 36, the homeowner completes manufacture of the above-indicated firecap 21 (FIGS. 4 and 5) by pouring concrete 38 within a plastic cup 39. The illustrated cup 39 has a flange 42 thereon and also a recessed handle (not shown). The size of the cup 39 is such as to seat relatively closely within the upper end of liner 10, as shown in FIG. 5. The underside of the cup 39 is recessed so as to permit fitting above knob 29, etc.

In the event of fire, heat may be conducted through the metal door 23 but such conduction is minimized due to the presence of the firecap thereabout. Such cap 21 is formed primarily of concrete, and thus is fire resistant and somewhat heat-conduction resistant.

In building his own safe, the homeowner may achieve (within large ranges) any desired size of the valuables chamber 44, any thicknesses of the walls around liner 10, and any thickness of door 23, etc. He may, furthermore, provide two doors if desired (one under the other, and each with its own set of bars).

For example, a second liner 45 which is flanged and open at its left end (FIG. 6) may be glued to one side of liner 10 around an opening cut out of such side. This provides a lateral space 47 for storage of additional contents. Such liners 45 may be provided on each side of liner 10.

To provide an extra safe place, an additional liner 48 may be provided beneath liner 10 as shown in FIG. 7, such additional liner being spaced beneath liner 10 in order that there will be concrete 49 therebetween. The resulting additional compartment holds valuables intended to be kept for an extremely long time without having access thereto, and these valuables are extremely safe since a burglar tapping on the walls of chamber 44 (even if he is successful in achieving access to such chamber 44) does not detect a hollow place at the bottom due to the presence of the intervening concrete 49.

It is pointed out that the liner may not only be injection molded or extruded but may be at least partially blow molded. Thus, for example, the upper (slotted) portion of extrusion 10 may be secured to a very large, bulb-like bottom so that the safe will be very large in size. Furthermore, the entire liner may be blow molded and the slots suitably formed therein.

In all embodiments of the invention, the plastic liner prevents chipping of the concrete as the door 23 is removed and reinserted on numerous occasions.

The safe is described in its vertical position, which is preferred, but it is understood that it may be turned on its side or poured in the horizontal condition and thus used as a wall safe.

Plastic (synthetic resin) is greatly preferred over metal, for example, as the material forming the liner. The plastic is rustproof, does not create jagged, dangerous edges at the slots, does not scratch paint coatings from the steel bars, and has various other advantages.

The firecap 21 is preferably provided with a thick, concrete-containing upper horizontal flange (reference being made to FIGS. 8 and 9 described below) which extends outwardly around the entire periphery of cup 39. Such flange is recessed into the mass 37 of concrete. Then, even when thermoplastic resin is used, and melts, a substantial degree of fire protection still remains. The cup 39 is placed in the upper end of liner 10 before any of the concrete is poured, and thus serves to prevent spillage of concrete into the valuables chamber.

Embodiment of FIGS. 8–10, and Particularly of Groove Means in the Liner

Referring to FIGS. 8 and 9, a liner 10*a* is shown which is injection molded, being preferably formed of high-impact styrene. Liner 10*a* is thin-walled and weak, as in the liner 10 of the previous embodiment, having no substantial burglar resistance except that provided by the associated bars, door, and surrounding concrete.

The illustrated liner 10*a* does not have openings all the way therethrough, as does the liner of the previous embodiment, but instead is provided with thin-walled grooves 16*a*, 22*a*, 24*a*, 25*a*, and 31*a* (FIG. 8) which respectively correspond in location and preferably sized to the slots 16, 22, 24, 25, and 31 shown in FIG. 1. Furthermore, the grooves are sufficiently deep and are so shaped as to receive the bars when the bars are mounted similarly to what is shown in FIG. 1*a*.

Thus, and referring to FIG. 10, groove 25*a* (for example) is shaped to receive bar 14. Groove 25*a* thus has an inwardly extending wall 61 (FIG. 8), a downwardly extending wall 62, and an outwardly extending wall 63 defining the groove adapted to receive bar 14. The lower surface of wall 63 is a stop surface against which the bolt 27 portion of lock 28 is adapted to bear in order to prevent opening of the door of the safe.

The walls of the remaining grooves shown in FIGS. 8–10 have such sizes and shapes as to receive the respective bars 11–13, and 15, as indicated above. These respective walls are not specifically numbered.

The operation of the present embodiment is the same as that described previously, except that the various bars seat in grooves instead of slots. There is no possibility that the concrete will enter the valuables chamber within the liner, since this is prevented by the groove walls. On the other hand, the present embodiment is characterized by requiring a high mold cost for injection molding, whereas the previous embodiment (FIG. 1, etc.) can be made with an extrusion of very low cost. In the embodiment of FIG. 1, the various bars are preferably coated with some corrosion-resistant substance, such as an epoxy coating, to prevent rusting and to enhance the ability of the door to slide thereon to closed position. The door is likewise epoxy coated. In the present embodiment, the bars need not be coated.

With the present embodiment, it is possible to so shape the grooves as to receive conventional "rebars" used in concrete construction work, thus reducing cost, but this is a very inferior construction and is not at all preferred.

Even less satisfactory is a construction where no bars are placed in the grooves, the concrete itself then filling enlarged grooves and providing some strengthing action.

Relocking Means

The relocking means is indicated at 65 in FIGS. 8–10, and is provided on all embodiments of the present invention. Thus, for example, it is to be understood as being present on the underside of the door 23 shown in FIGS. 3 and 5 and as cooperating with the bar 15 of such Figures.

Referring now to FIGS. 8 and 9 in particular, the relocking means 65 has one portion 66 seated closely below lock 28, another portion 67 adapted to hook beneath the strong bar 15 (and its enclosing groove walls) in response to forcing of a burglar tool through lock 28, and bendable means 68 which associates the portions 66 and 67 with each other.

More specifically, the bendable means 68 comprises legs which are strongly secured to the door 23 adjacent one edge thereof, the legs being strong but being adapted to bend when the burglar forcibly shifts a tool such as heavy-duty screwdriver 69 (FIG. 10) through the lock. When the legs 68 thus bend, the relationships are such that the other portion 67 hooks below bar 15 and effectively prevents opening of the door. The legs are so strong that once the portion 67 is below bar 15, the typical burglar will be unable to move such portion 67 back to a position where it is not blocked by bar 15.

The lock 28 is connected to the combination knob 29 by a shaft extending through an opening in door 23. When a typical burglar attempts to break into the safe, it frequently occurs that the first thing he does is find some sort of a hammer, sledge, etc., and pound away the knob 29. He then takes an implement (such as 69) and drives downwardly on the shaft in the door opening, with great force, so that the shaft and implement penetrate the bottom wall of lock 28. Bolt 27 is then held outwardly by the above-described deadbolt action, but in the event lock 28 is not extremely strong there is (in the absence of element 65) still the possibility that the burglar could force open the door by pulling it (as by some lifting device) away from the lock and bolt. Because of the presence of element 65, this possibility is minimized in that element 65 is very strong, is strongly secured to the door, and remains below bar 15. In the present apparatus, one of the numerous advantages of the relocking mechanism is that an implement thus pounded through the door opening tends to bend and be gripped or grabbed by the element 65 due to the fact that the legs 68 are exerting a great reverse force tending to shift the lock upwardly. When this occurs, the burglar loses the implement, in effect, and is thus further thwarted in his attempt to break into the safe.

The operation described in the preceding paragraph also occurs in the case of locks operated by keys instead of combination knobs. There is a lock portion (into which the key is adapted to be inserted) which extends upwardly into an opening in the door 23. This portion is what is forced downwardly by the burglar, using a suitable implement, when he attempts to break into the safe. The operation is the same as that described in the preceding paragraph.

The illustrated relocking means 65 is extremely simple and economical to construct. It is made out of a single rectangular piece (plate) of heavy-gauge sheet steel, being preferably about 5/32 inch thick. Side regions of the plate are slit, following which the legs 68 are bent upwardly relative to the body (which is the "one portion" 66 referred to above), the amount of bending being such that the legs are at an obtuse angle relative to the body and an acute angle relative to the door. The other portion 67 of the relock means is the edge portion which is bent downwardly in curved relationship from the body, and which is adjacent the inner edge of bar 15 when the door is closed. Thus, even a relatively small amount of bending of the legs will cause the edge 67 to shift beneath bar 15 for relocking purposes.

The ends of the legs are secured to the door by any suitable means, preferably by strong bolts 70 which extend into threaded openings in the door. Such openings, of course, do not extend clear to the upper side of the door.

The legs 68 straddle the lock, being on opposite sides of the lock end having the bolt 27. The bolts 70 and the leg ends are disposed adjacent the corners of that side of the lock from which the bolt 27 projects.

Preferred Fire Door

Referring to FIGS. 8 and 9, there is shown a fire-resistant door which is a great improvement over the one shown in FIGS. 4 and 5, and, therefore, is much preferred.

The door comprises an open-topped container 72 of high impact styrene, and adapted to receive a mass of concrete 73 during the do-it-yourself construction of the safe. The resulting door is relatively heavy and fire resistant, weighing (for example) about nine pounds.

A lower part 74 of the container has downward-convergent side (but not end) walls. It fits into the upper end of liner **10*a* (or of the liner 10 of the previous embodiment). To reduce friction, vertical beads 75 and 75*a* (FIG. 8) are provided integrally on such lower part at the lower vertical walls thereof. At the extreme upper region of the entire periphery of the lower part, a small vertical sealing portion 76** is not beaded, so that it will be a continuous snug fit in the upper liner end and will provide a sealing action.

A shoulder 77 extends outwardly a slight distance, above the small portion 76, and seats on the extreme upper edge of the liner **10*a*. An additional portion 78 of the container extends vertically upwardly from shoulder 77, and merges at its upper edge with an outwardly extending portion 79 which overhangs the surrounding concrete to a considerable extent. The outwardly extending portion merges with an upwardly extending portion 80 which has a lip 81** at its upper region.

In the construction and operation of the present fire door, the lower portion 74 is inserted into the upper end of the liner during pouring of concrete, and concrete is poured both in the container 72 and around the entire liner as described relative to the first embodiment. The concrete tends to reduce the size of the liner a slight amount, making the small sealing portion 76 a very snug fit in the interior of the upper end of the liner. However, because of the presence of the vertical beads 75 and **75*a* below sealing portion 76, and because the sealing portion is so small, this small snug-fitting region does not create an excessive hindrance to withdrawal and replacement of the entire door as the safe is used. (To facilitate removal, concrete regions below parts of lip 81** are scooped away after pouring of the concrete.)

Let it be assumed that the fire is sufficiently hot to melt the high-impact styrene. The nine-pound weight of the concrete then causes a small downward movement of the fire door due to melting of the plastic. However, it is impossible for the fire door to drop into the interior of the safe since the concrete region surrounding the fire door is overhung by the concrete in the upper portion of the door. Instead, a sealing action is provided preventing entrance of hot gas and also water (the latter coming from the fireman's hoses) as the fire is extinguished. Thus, the contents of the safe are not contacted by water, nor are they damaged by the heat of a typical fire.

It is pointed out that all items used in this application are relative. No safe is impervious to cracking by a professional burglar who has sufficient time. Also, almost any safe will not withstand a fire of sufficient intensity and duration. What the present safe achieves is surprisingly great fire and burglar resistance at low cost.

The foregoing detailed description is to be clearly understood as given by way of illustration and example only, the spirit and scope of this invention being limited solely by the appended claims.

The synthetic resin liner and tightly closed fire door create a very high degree of resistance to moisture in the air and in the ground, which is of major importance regarding storage of papers, guns, etc.

To further seal the valuables chamber against ingress of moisture, grout, etc. a polyethylene bag is placed around the assembled liner and bars prior to pouring of the concrete.

I claim:

1. A method of providing and constructing a do-it-yourself safe for storage of valuables, which method comprises:

(a) providing a strong element adapted to be partially embedded in concrete, (b) providing a liner adapted to have concrete poured on the exterior thereof and adapted to receive valuables on the interior thereof, and having an opening therein into which part of said strong element may be inserted, said opening being selected from a class consisting of grooves and slots, (c) providing a strong door adapted to be disposed on the interior of said liner, and to cooperate with said part of said strong element, when said part is inserted into said opening, in resisting access by a burglar into the interior of the safe, (d) inserting only a part of said strong element into said opening, sand (e) embedding in concrete said liner and remaining parts of said strong element.

2. The invention as claimed in claim 1, in which said opening is a slot, and in which said method further comprises so correlating the size and shape of said opening to the size and shape of said strong element that said strong element closes said opening, and prevents substantial ingress of grout therethrough when said part of said strong element is inserted through said opening.

3. The invention as claimed in claim 1, in which said method further comprises so correlating said element and said opening to each other that only a precisely determined region of said element is inserted into said opening.

4. The invention as claimed in claim 1, in which said opening is a slot, and in which said method further comprises so correlating the size and shape of said opening to the size and shape of said strong element that said strong element closes said opening, and prevents substantial flow of grout therethrough, when said part of said strong element is inserted through said opening, and in which said method further comprises so correlating said element and said opening to each other that only a precisely determined region of said element is inserted through said opening.

5. The invention as claimed in claim 1, in which said method further comprises providing said strong element in the form of a steel bar, providing said opening in the form of a slot, and so correlating said liner, slot, and bar that only a predetermined side edge area of said bar is introduced through said slot.

6. The invention as claimed in claim 5, in which said method further comprises so correlating the shapes and sizes of said bar and slot that said bar is a light press fit in said slot.

7. The invention as claimed in claim 1, in which said method further comprises providing as said strong element a steel bar, providing said opening in the form of a groove, so correlating said liner, groove and bar that only a predetermined side edge area of said bar is introduced into said groove, and so locating said groove that said side edge area forms a stop preventing opening of said door.

8. A method of constructing a safe, which comprises:

(a) providing exterior and interior forms for concrete and which are spaced from each other sufficiently far that a thick-walled concrete container for valuables will result from pouring of concrete between said forms, the container having an access region into the valuables cavity, (b) extending a strong, burglar-resistant element into an opening in said interior form in proximity to said access region, (c) pouring concrete between said forms to embed in concrete portions of said strong element which are not in said opening, and (d) providing a door in said access region and associated with the part of said strong element which is in said opening, in such manner that said one part aids in maintaining said door closed and resistant to burglars.

9. The invention as claimed in claim 8, in which said strong element is a steel bar so correlated to said opening that the amount of said extension related in step (b) is limited to a predetermined value, and in which said method further comprises effecting said extension of step (b) to the full extent possible to thus achieve said predetermined value.

10. The invention as claimed in claim 8, in which said method further comprises effecting frictional retention of said strong element in said inner-form opening prior to and during pouring of said concrete.

11. The invention as claimed in claim 8, in which said strong element is a steel bar so correlated to said opening that the amount of said extension related in step (b) is limited to a predetermined value, in which said method further comprises effecting said extension of step (b) to the full extent possible to thus achieve said predetermined value, and in which said method further comprises effecting frictional retention of said steel bar in said innter-form opening prior to and during pouring of said concrete.

12. The invention as claimed in claim 8, in which said method further comprises filling with concrete a cup-like element adapted to fit snugly in said access region, and employing the resulting element as a fire cap exterior to said door.

13. The invention as claimed in claim 8, in which said opening in said interior form is a slot, and said strong element is a steel bar.

14. The invention as claimed in claim 8, in which said opening in said interior form is a groove, and said strong element is a steel bar, and in which said interior form is sufficiently thin that regions of the wall defining said groove protrude inwardly into said access region and thus block said door when strengthened by said bar.

15. The invention as claimed in claim 8, in which said method further comprises providing as said interior form a thin-walled element not having substantial burglar resistance until associated with said strong element and said concrete.

16. The invention as claimed in claim 15, in which said interior form is composed of synthetic resin.

* * * * *